United States Patent [19]

Roush, Jr.

[11] 4,433,629

[45] Feb. 28, 1984

[54] RAILWAY TRUCK BEARING MOUNTING ASSEMBLY

[75] Inventor: Roy W. Roush, Jr., Downers Grove, Ill.

[73] Assignee: General Motors Corporation, Detroit, Mich.

[21] Appl. No.: 328,941

[22] Filed: Dec. 9, 1981

[51] Int. Cl.[3] ..... B61F 5/30

[52] U.S. Cl. ..... 105/222; 105/224 R; 105/224.1; 105/225; 267/3; 267/140

[58] Field of Search ..... 105/218 R, 222, 224 R, 105/224 A, 224.1, 225; 308/180; 384/125, 215, 220, 223, 224; 267/3, 140

[56] References Cited

U.S. PATENT DOCUMENTS

| | | | |
|---|---|---|---|
| Re. 16,451 | 11/1926 | Bruce | 308/180 |
| 2,047,666 | 7/1936 | Blunt | 105/222 X |
| 2,813,764 | 11/1957 | Brittain, Jr. | 308/180 |
| 3,519,260 | 7/1970 | Irwin | 384/215 X |
| 3,865,443 | 2/1975 | James | 384/223 X |
| 4,044,689 | 8/1977 | Eggert, Jr. | 105/224.1 X |
| 4,131,069 | 12/1978 | List | 105/224.1 X |
| 4,173,933 | 11/1979 | Kayserling | 105/224 R X |
| 4,175,804 | 11/1979 | Pannwitz | 384/223 |
| 4,258,629 | 3/1981 | Jackson et al. | 105/224.1 X |
| 4,278,029 | 7/1981 | Eggert, Jr. | 105/224.1 |

FOREIGN PATENT DOCUMENTS

| | | | |
|---|---|---|---|
| 887747 | 2/1981 | Belgium . | |
| 1917186 | 10/1970 | Fed. Rep. of Germany | 105/222 |

*Primary Examiner*—Robert B. Reeves
*Assistant Examiner*—David F. Hubbuch
*Attorney, Agent, or Firm*—Patrick M. Griffin

[57] ABSTRACT

The bearing housing of a railway vehicle includes a pair of stop members spaced from respective pedestals of the truck frame and engageable with such pedestals to absorb lateral thrust loads upon relative movement between the bearing housings and truck frame. Each stop member includes an elastomer pad mounted to the bearing housing and a wear plate engageable with the pedestal of the truck frame.

2 Claims, 5 Drawing Figures

RAILWAY TRUCK BEARING MOUNTING ASSEMBLY

BACKGROUND OF THE INVENTION

This invention relates to rail vehicle trucks and specifically to a lateral load absorbing assembly for mounting a bearing supported axle to a rail vehicle truck.

When a rail vehicle truck having a number of axles held parallel or in fixed relation to one another passes through a curve, the truck experiences "basic" lateral loading forces, known as curve negotiation forces which are related not to centrifugal force but, rather, the frictional forces between the rails and wheels. These forces would be present if the vehicle truck were stationary and the rails were moving beneath it with no driving or braking force, and these forces result from the fact that all wheels of the truck cannot line up tangent to the rails, especially with multiple axle trucks.

In addition to these "basic" lateral forces which occur with even theoretically perfect wheel and rail interaction, other dynamic lateral forces occur as a result of the inevitable imperfections and wear in the rails and wheels, and the wheels passing through switches and crossovers. These lateral forces are transmitted through the axle to the bearing and bearing housings supporting the axle on the truck.

The axles of a rail vehicle truck are rotatively supported parallel to one another in the truck frame by bearing assemblies which are mounted to the truck frame, generally within bearing housings which fit between members of the truck frame known as pedestals. The bearings themselves may be of the cylindrical roller type, in which case the axle end may move within the bearing housing laterally of the truck frame, while a thrust bearing located at the end of the bearing housing takes the lateral load of the end of the moving axle. In addition, a resilient element at the end of the bearing housing absorbs and cushions the lateral load induced thereon. Such a bearing mounting assembly is shown in the patent to Brittain U.S. Pat. No. 2,813,764. The bearing supporting the axle may also be of a tapered roller type, in which case the lateral motion just described is not feasible within the bearing housing itself, and the bearing housing instead will itself slide within the pedestal relative to the truck frame, with the axle rigid to the bearing and the bearing housing closely containing the bearing. Such a bearing mounting assembly is shown in the patent to Keller et al. U.S. Pat. No. 3,672,735. The structure shown there includes wear plates mounted between the truck frame and the bearing housing which are abraded under the frictional forces resulting from the sliding movement of the bearing housing, but includes no means for resiliently absorbing the thrust loads induced during curve negotiation.

It is known to provide rubber cushioning members internal to a tapered roller bearing housing. Janeway U.S. Pat. Nos. 2,267,466 and 2,335,120 each shows a composite metal and vulcanized rubber cushion assembly tightly bonded between a housing and a tapered bearing on a shaft. Because of the way the rubber assembly is bonded into the bearing housing, the rubber acts in vertical shear to absorb loads. It is obvious that a load absorbing assembly internal to a housing, besides being complex, is not easily removed and replaced. Such an assembly can also, of course, not be incorporated into a standard bearing housing without substantial modification to create the interior room necessary. These considerations are true for any bearing housing with an internal thrust absorption device.

SUMMARY OF THE INVENTION

The subject invention solves the problems outlined above by providing an assembly for mounting the bearings of a rotatably supported axle to a truck frame with bearing housings which include thereon a lateral thrust absorption pad which is compressed between the bearing housing and the truck frame. The thrust pad acts in compression to absorb the lateral thrust loads and may be easily removed and replaced since it is entirely external.

In the subject invention, a conventional truck frame has one or more axles mounted thereto in parallel fashion by bearings which are axially rigid to the ends of the axles and which are contained by bearing housings, one housing on each end of each axle. The bearing housings are slidably mounted between pedestals of the truck frame and are retained vertically between the pedestals in conventional fashion. Each bearing housing includes a pair of stop members thereon which confront the inside of the frame pedestals and are laterally spaced therefrom by a predetermined amount. Each stop member has mounted thereto a lateral thrust load absorption pad comprised of an elastomer pad bonded to a hardened wear plate. As the rail vehicle and truck frame negotiate a curve, the bearing housing moves laterally with respect to the truck frame as it slides through the pedestals, and the hardened wear plate contacts the pedestals of the truck frame compressing the elastomer pad. The predetermined clearance between the stop member and the pedestals of the truck frame is sufficient to allow a given amount of lateral movement and to allow the elastomer pad to be compressed to absorb the lateral thrust load. One set of thrust absorption pads on each bearing absorbs the lateral thrust loads for each direction of lateral axle movement.

It is therefore an object of the invention to provide an assembly for mounting a bearing to a truck frame which includes a lateral thrust load absorption means which is entirely external to the housing of the bearings. It is a further object of the invention to provide a lateral thrust load absorption means including an elastomer pad which is compressed between the bearing housing and the truck frame to absorb the lateral thrust loads induced between the bearing housing and the truck frame. It is yet another object of the invention to provide a bearing housing slidably mounted to the truck frame including stop members spaced from the truck frame to allow a predetermined lateral movement of the bearing housing with respect thereto to allow the thrust absorption pad to be compressed between the stop member and the truck frame as the bearing housing moves laterally with respect thereto to absorp the thrust loads induced thereby.

BRIEF DESCRIPTION OF THE DRAWINGS

These and other objects of the invention will appear from the following written description and drawings in which.

DESCRIPTION OF THE PREFERRED EMBODIMENT

Figure 1:
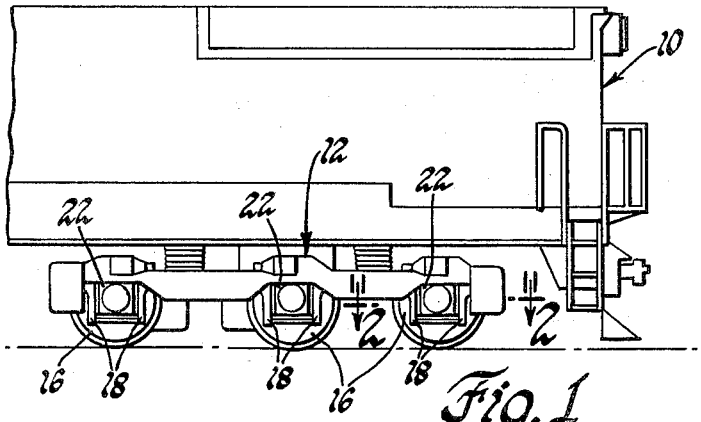
FIG. 1 is a side view of a conventional three axle locomotive truck frame.

Referring first to FIG. 1, a locomotive 10 includes a conventional truck frame 12 which includes three axles 14 rotatively supported thereon in parallel. Each axle includes a pair of wheels 16. As locomotive 10 negotiates curved rails, wheels 16 on parallel axles 14 cannot line up all at once tangent to the curved rails, and the frictional curve negotiation forces thereby induced on wheels 16 will cause axles 14 to move laterally with respect to truck frame 12. This lateral movement induces lateral thrust loads which it is desirable to cushion and absorb, in addition to the dynamic loads.

Figure 2:
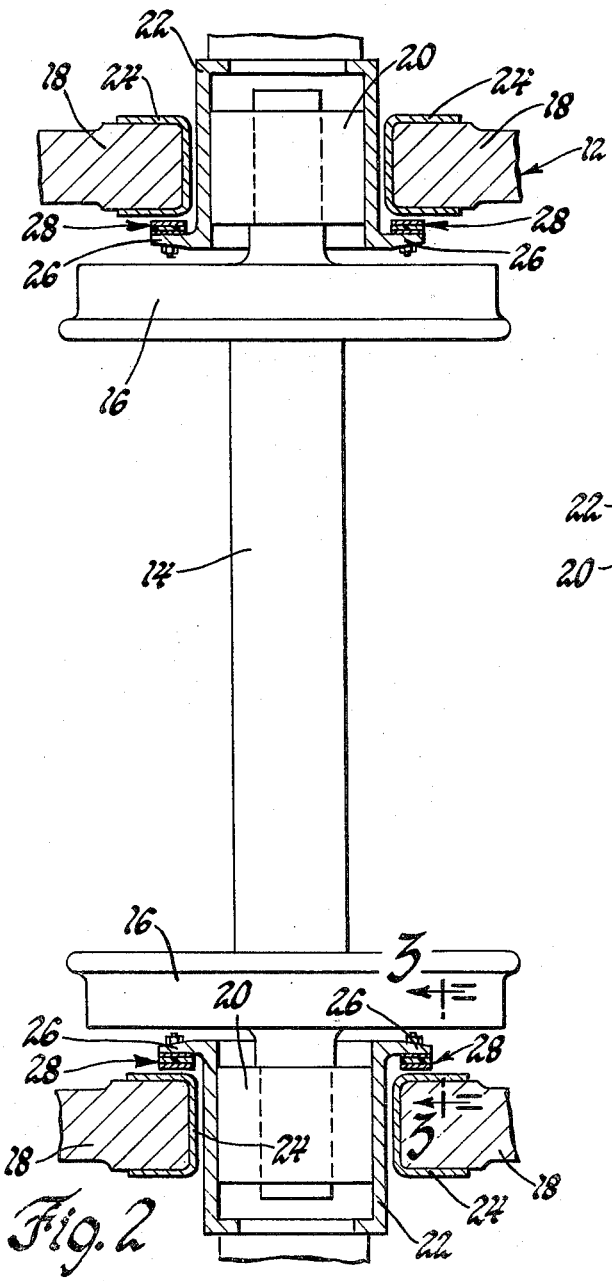
FIG. 2 is a cross-sectional view along the line 2—2 of FIG. 1 showing an axle slidably mounted to the truck frame and showing two bearing housings in cross-section.

Referring next to FIG. 2, details of the mounting of an axle 14 to truck frame 10 may be seen. Truck frame 12 includes six spaced pairs of pedestals 18, two pairs for each axle 14. A tapered bearing assembly 20 is mounted to each end of axle 14. The details of tapered bearing assembly 20 form no part of the invention and are conventional. Each tapered bearing assembly 20 is contained within a bearing housing 22 which in turn is slidably fitted between pedestals 18 with a conventional wear liner 24 mounted therebetween. As wheels 16 are moved laterally by the rails during curve negotiation, each axle 14 moves laterally taking its bearings 20 and bearing housings 22 with it. Wear liners 24 are abraded as bearing housings 22 move past their respective liners.

To limit the lateral movement of bearing housings 22, each bearing housing includes thereon a pair of stop members 26 which are cast as integral ears to bearing housing 22, although they could be joined thereto by any desired means of sufficient rigidity. The stop members 26 are spaced from truck frame 12, and specifically opposite respective wear liners 24 on pedestals 18, by a predetermined clearance to allow a predetermined lateral movement of bearing housings 22 with respect to the pedestals of truck frame 12. This clearance is designed to meet several objectives. First of all, the clearance leaves sufficient room for a lateral thrust load absorption pad designated generally 28 to be mounted on each stop member 26. Furthermore, there is predetermined clearance between the pads and opposed wear liners 24 to allow lateral movement of bearing housings 22 with respect to truck frame 12 with no contact between the thrust pads 28 and opposed wear liners 24. This allows each axle 14 to seek its own equilibrium during normal travel, a process known as "hunting". This predetermined clearance also allows ease of assembly and removal of bearing housings 22. The amount of this clearance will, of course, depend upon the individual characteristics of the rail vehicle and truck involved.

Figure 3:
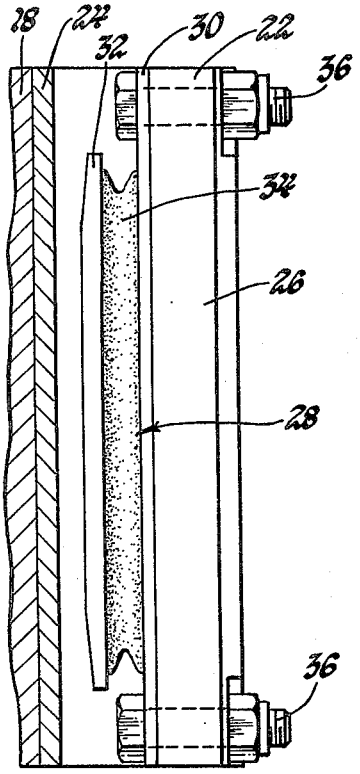
FIG. 3 is a view along the line 3—3 of FIG. 2 showing a thrust pad mounted to a stop member.
Figure 4:
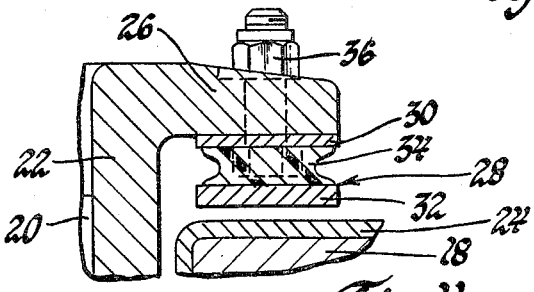
FIG. 4 is an enlarged view of a portion of FIG. 2 showing the thrust pad.
Figure 5:
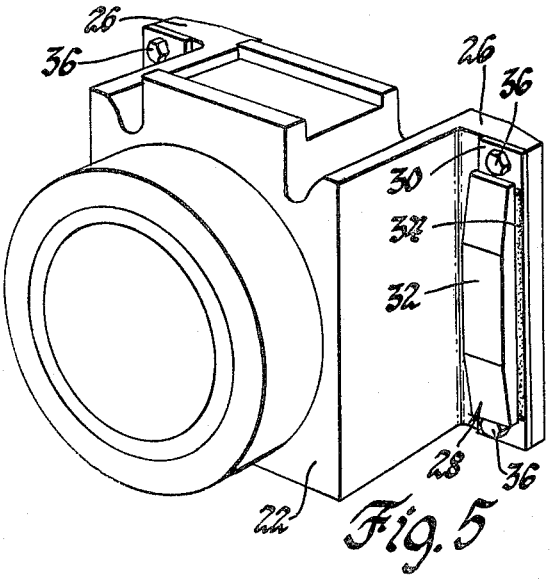
FIG. 5 is a perspective view of a bearing housing and thrust pad mounted thereto.

Referring now to FIGS. 3 through 5, the details of a thrust pad 28 and its mounting to a stop member 26 may be seen. Each thrust pad 28 includes a mounting plate 30, a hardened contactor wear plate 32 and an elastomer pad 34 bonded therebetween creating an integral unit. Mounting plate 30 is of metal or other suitable material and is bolted at 36 to stop member 26. Hardened wear plate 32 is also formed of metal or other suitable material and is chamfered or slightly curved at the ends thereof. Elastomer pad 34 is formed of rubber or other suitable material. In the embodiment disclosed, pad 34 is formed of rubber with a durometer hardness of approximately 45 and a thickness of approximately half an inch, while the complete thrust pad assembly 28 has a total thickness of approximately 1.2". Bolts 36 allow thrust pad 28 to be easily removed from bearing housing 22 for servicing, replacement, etc.

The operation of thrust pads 28 may be understood by referring to FIGS. 2, 3 and 4. As the locomotive 10 rounds a curve, one bearing housing 22 and its respective one stop members 26 will move laterally outwardly with respect to truck frame 12 while the other bearing housing 22 and its respective other stop members 26 will move laterally inwardly with respect to the truck frame. The hardened wear plates 32 of the one stop members 26 will move toward their respective wear liners 24 through the predetermined clearance therebetween. The wear liners may or may not contact the wear plates depending on the radius of the curve in the tracks. If the wear plates move through the predetermined clearance distance, they will contact the wear liners and begin to compress the elastomer pads 34. This compression will continue until each elastomer pad 34 has reached its compressive limit. In the embodiment disclosed, the elastomer pads 34 will deflect over approximately 0.25" and each pad will absorb approximately 15,000 pounds in lateral loading, a total of 30,000 for each pair of thrust pads 28 on each bearing housing 22. This may, of course, be varied by varying the thickness, hardness, etc. of the elastomer pads 34, as well as making them longer or wider as desired. A thicker pad 34 and a thicker total thrust pad assembly 28 would necessitate an increased spacing of stop members 26 from wear liners 24 to provide sufficient clearance for the "hunting" motion described above.

Another modification of the structure disclosed may be made without affecting the operation of the invention. If desired, the thrust pads 28 could be mounted to a portion of truck frame 12 itself, such as pedestals 18, and confront and be compressed against the stop members 26 or some other portion of the bearing housings 22. Both structures provide several advantages over the prior art. Since the thrust pads 28 are entirely external to the bearing housings 22, they may be incorporated with bearings of any design with no modification to the internal workings or extensive retrofitting. Stop members 26 or the equivalent exist on many standard bearing housings or they may be easily added. Since the thrust pads 28 are external, they may be easily modified as to thickness, width, length, etc., and may be easily removed for replacement or servicing, due to fatigue of pads 34 or excessive abrading of wear plates 32. In addition, because the compressive motion of pads 28 is external to the bearing housings 22, there is no pumping or wearing action internally of bearing housings 22 and the internal workings of bearings 20 are entirely unaffected. The external mounting of thrust pads 28 gives complete flexibility for different sizes, weights, and structures of truck frames, and even to changing conditions for the same truck frame.

Thus the subject invention provides a lateral thrust load absorption means for a bearing mounting assembly which is external to the bearing housing, and which provides an elastomer pad which is removable and which may be easily tailored to different truck frames and may be easily retrofitted to existing bearing assemblies.

The embodiments of the invention in which an exclusive property or privilege is claimed are defined as follows:

1. In a locomotive truck or the like of the type having a truck frame and an axle having the ends thereof supported rotatably on the truck frame by bearings, an assembly for mounting the bearings to the truck frame, comprising, a pair of bearing housings, each containing a respective one of the bearings of the axle, means freely slidably mounting each bearing housing to the truck frame to allow unrestricted lateral movement of the axle and bearing housings as a unit relative to the truck frame between predetermined limits, each bearing housing including at least one stop member in confronting relation to a respective stop member on the truck frame and laterally spaced therefrom by a predetermined amount within said predetermined limits, the stop member of one bearing housing moving laterally toward the respective stop member of the truck frame as the bearing housings and axle move as a unit laterally in one direction, the stop member of the other bearing housing moving laterally toward the respective stop member of the truck frame as the axle and other bearing housing move as a unit laterally in the other direction, and lateral thrust load absorption means associated with each bearing housing including an elastomer pad mounted to one of the respective stop members and a contact plate secured thereto in confronting relation to the other respective stop member and spaced therefrom to allow lateral movement of the axle and bearing housing freely within said predetermined limits, lateral movement of the axle and bearing housings as a unit in one direction beyond one predetermined limit compressing the elastomer pad and contact plate between the respective stop members of one bearing housing and truck frame to absorb the lateral thrust load, lateral movement of the bearing housings and axle as a unit in the other direction beyond the other predetermined limit compressing the elastomer pad and contact plate between the respective stop members of the other bearing housing and truck frame to absorb the lateral thrust load, thereby preventing uncushioned contact between bearing housing and truck frame due to the lateral movement of the bearing housings and axle in either direction.

2. In a locomotive truck or the like of the type having a truck frame and an axle having the ends thereof supported rotatably on the truck frame by bearings, an assembly for mounting the bearings to the truck frame, comprising, a pair of bearing housings, each containing a respective one of the bearings of the axle, means freely slidably mounting each bearing housing to the truck frame to allow unrestricted lateral movement of the axle and bearing housings as a unit relative to the truck frame between predetermined limits, each bearing housing including a pair of stop members in confronting relation to respective stop members on the truck frame and laterally spaced therefrom by a predetermined amount within said predetermined limits, the stop members of one bearing housing moving laterally toward the respective stop members of the truck frame as the bearing housing and axle move as a unit laterally in one direction, the stop members of the other bearing housing moving laterally toward the respective stop members of the truck frame as the axle and other bearing housing move as a unit laterally in the other direction, and lateral thrust load absorption pads mounted to each stop member of each bearing housing including a mounting plate removably attached to the stop member, an elastomer pad secured to the mounting plate, and a contact plate secured to the elastomer pad in confronting relation to a respective truck frame stop member and spaced therefrom to allow lateral movement of the axle and bearing housing freely within said predetermined limits, lateral movement of the axle and bearing housing as a unit in one direction beyond one predetermined limit engaging the contact plates with the respective truck frame stop members to compress the elastomer pads and absorb the lateral thrust load, lateral movement of the bearing housings and axle as a unit in the other direction beyond the other predetermined limit engaging the contact plates of the other bearing housing with the respective truck frame stop members to compress the elastomer pads and absorb the lateral thrust load, thereby preventing uncushioned contact between bearing housing and truck frame due to the lateral movement of the bearing housings and axis in either direction.

* * * * *